US009541316B2

(12) United States Patent
Takeda et al.

(10) Patent No.: US 9,541,316 B2
(45) Date of Patent: Jan. 10, 2017

(54) ACCUMULATOR

(75) Inventors: Yukihiko Takeda, Aichi-gun (JP); Kenichi Fujiwara, Kariya (JP); Teruyuki Hotta, Nagoya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 281 days.

(21) Appl. No.: 14/360,827

(22) PCT Filed: Sep. 5, 2012

(86) PCT No.: PCT/JP2012/072633

§ 371 (c)(1),
(2), (4) Date: May 27, 2014

(87) PCT Pub. No.: WO2013/080620

PCT Pub. Date: Jun. 6, 2013

(65) Prior Publication Data

US 2014/0331713 A1 Nov. 13, 2014

(30) Foreign Application Priority Data

Nov. 29, 2011 (JP) ..... 2011-260889

(51) Int. Cl.
*F25B 43/00* (2006.01)

(52) U.S. Cl.
CPC ..... *F25B 43/006* (2013.01)

(58) Field of Classification Search
CPC ..... F25B 43/006; F25B 43/00; F25B 2400/02; F25B 43/02; F25B 5/02; F17C 13/00; Y10T 29/49394

(Continued)

(56) References Cited

U.S. PATENT DOCUMENTS 4,111,005 A * 9/1978 Livesay ..... F25B 43/006 55/463
4,270,934 A * 6/1981 Widdowson ..... B01D 45/06 55/391

(Continued)

FOREIGN PATENT DOCUMENTS

DE 10 2005059482 6/2007
JP S60-050767 4/1985

(Continued)

OTHER PUBLICATIONS

Office Action mailed Sep. 2, 2014 in corresponding JP Application No. 2011-260889 with English translation.

(Continued)

*Primary Examiner* — Mohammad M Ali
(74) *Attorney, Agent, or Firm* — Harness, Dickey & Pierce, P.L.C.

(57) ABSTRACT

An accumulator is disposed in a refrigerant circuit at a position on the suction side of a compressor, separates the gas and liquid phases of the refrigerant, and contains the liquid refrigerant. The accumulator comprises: a pressure container (2) having an inner space (S) formed therein; a refrigerant inlet opening (5) provided in the pressure container; a refrigerant outlet opening (6); a conduction pipe (8) for conducting a refrigerant within the pressure container to the outlet opening; and a gas-liquid separation means (15) provided with a separation plate (16) provided within the pressure container so as to face the inlet opening and so as to expand substantially perpendicularly to the direction of the line of flow at the inlet opening. The gas-liquid separation means has, in the region of the separation plate which faces the inlet opening, a mountain-shaped protrusion (18) having a crest (18*a*) and a sloped surface (18*b*), the crest (18*a*) protruding toward the inlet opening.

7 Claims, 3 Drawing Sheets

(58) Field of Classification Search
USPC ..... 62/503
See application file for complete search history.

(56) References Cited

U.S. PATENT DOCUMENTS

| | | | | | |
|---|---|---|---|---|---|
| 4,651,540 | A * | 3/1987 | Morse | F25B 43/006 | 55/441 |
| 4,768,355 | A * | 9/1988 | Breuhan | F25B 43/006 | 261/DIG. 6 |
| 4,776,183 | A * | 10/1988 | Okoma | F25B 43/006 | 55/308 |
| 4,827,725 | A * | 5/1989 | Morse | F25B 43/006 | 62/503 |
| 5,052,193 | A * | 10/1991 | Pettitt | F25B 43/006 | 55/463 |
| 5,076,071 | A * | 12/1991 | Morse | F25B 43/006 | 62/503 |
| 5,179,844 | A * | 1/1993 | Lyman | F25B 43/006 | 62/503 |
| 5,347,817 | A * | 9/1994 | Kim | F25B 43/006 | 62/471 |
| 5,787,729 | A * | 8/1998 | Wijaya | B01D 45/08 | 210/456 |
| 5,868,001 | A * | 2/1999 | Shoulders | F04B 39/02 | 62/470 |
| 6,178,771 | B1 * | 1/2001 | Yun | F04B 39/04 | 62/471 |
| 2007/0144207 | A1 | 6/2007 | Klotten et al. | | |
| 2008/0223073 | A1 * | 9/2008 | Fralick | F25B 43/006 | 62/503 |

FOREIGN PATENT DOCUMENTS

| | | | |
|---|---|---|---|
| JP | S60-188971 | | 12/1985 |
| JP | S61-172975 | U | 10/1986 |
| JP | S62-4848 | Y2 | 2/1987 |
| JP | H06-117730 | A | 4/1994 |
| JP | H06-35601 | U | 5/1994 |
| JP | H09-133437 | A | 5/1997 |
| JP | H10-62037 | A | 3/1998 |
| JP | 2000-320930 | A | 11/2000 |
| JP | 2000-329430 | | 11/2000 |
| JP | 2000-356439 | A | 12/2000 |
| JP | 2002-130871 | A | 5/2002 |
| JP | 2005-163744 | | 6/2005 |
| JP | 2005-164109 | | 6/2005 |
| JP | 2007-051560 | A | 3/2007 |
| JP | 2007-155329 | | 6/2007 |
| JP | 2009-047393 | A | 3/2009 |
| JP | 2010-096483 | | 4/2010 |
| WO | WO-2012/026004 | A1 | 3/2012 |

OTHER PUBLICATIONS

Office Action issued on Jan. 21, 2014 to the corresponding JP application 2011-260889.
International Search Report for PCT/JP2012/072633, ISA/JP, mailed Dec. 11, 2012.
Office Action issued Apr. 3, 2015 in the corresponding Chinese application No. 201280048573.0. (in Chinese with English translation).
Extended European search report dated May 21, 2015 in corresponding European Application No. 12852573.0.

* cited by examiner

PRIOR ART

ACCUMULATOR

CROSS-REFERENCE TO RELATED APPLICATIONS

This application is a 371 U.S. National Stage of International Application No. PCT/JP2012/072633, filed Sep. 5, 2012. This application claims priority to Japanese Patent Application No. 2011-260889, filed Nov. 29, 2011. The disclosures of the above applications are incorporated herein by reference.

TECHNICAL FIELD

The present invention relates to an accumulator which is arranged at a suction side of a compressor in a refrigerant circuit, separates the gas and liquid of the refrigerant, and stores the liquid refrigerant.

BACKGROUND ART

As the above-mentioned accumulator, there is known one of a type which arranges a gas-liquid separating plate at the inside and makes the gas/liquid dual phase refrigerant strike it, as shown in for example FIG. 9 of PLT 1. FIG. 5 is a view which shows an accumulator of FIG. 9 of PLT 1. This accumulator is provided with an inlet 105 and outlet 106 of a fluid which are arranged in parallel at a top part of a pressure vessel 102, a double wall tube 108 which guides the gas refrigerant to the outlet, and a gas/liquid separating plate (umbrella-shaped member) 115 which spreads out in a substantially conical shape or umbrella shape so as to cover a gas refrigerant inflow port of the double wall tube 108. The gas/liquid dual phase state refrigerant which flows in from the inlet 105 is separated into a gas and liquid by striking the umbrella shaped member 115 whereby the gaseous refrigerant flows through a circumferential gap S3 between the umbrella shaped member 115 and the inside surface of the pressure vessel 102, flows from the top end of the outside tube 110 of the double wall tube to the inside of the double wall tube, descends, then rises inside the inside tube 109 and is sent from the outlet 106 to a compressor (not Shown). The separated liquid refrigerant and oil which had been contained in the refrigerant flow down through the circumferential gap S3 between the umbrella shaped member and the inside wall of the vessel to be stored at the bottom part of the vessel.

In this regard, in the accumulator of FIG. 9, the flow cross-sectional area changes so as to expand while transitioning from the inflow port 105 to the space S2 above the umbrella shaped member 115, then being reduced at the circumferential gap S3 between the umbrella shaped member 115 and the vessel inside surface, but a relatively large pressure loss of the refrigerant occurred due to this change of the flow cross-sectional area.

CITATIONS LIST

Patent Literature

PLT 1. JP 2000-356439 A

SUMMARY OF INVENTION

Technical Problem

The accumulator according to the prior art which is shown in FIG. 5 sufficiently performs the function demanded and as a result the operation of the compressor can be suitably maintained, but there is the problem that the pressure loss which arises there is relatively large and as a result the refrigeration cycle system falls in efficiency.

The present invention is made in consideration of the above problem and has as its object the provision of an accumulator for refrigerant use with a small pressure loss.

Solution to Problem

To solve the above problem, the present invention provides an accumulator (1) arranged at a suction side of a compressor in a refrigerant circuit, and adapted to separate a refrigerant into a gas and liquid and store the liquid refrigerant, the accumulator (1) comprising a pressure vessel (2) which forms an inside space (S), an inflow port (5) of the refrigerant and an outflow port (6) of the refrigerant which are provided at the pressure vessel (2), a conduit (8) which guides the refrigerant in the pressure vessel (2) to the outflow port (6), and a gas-liquid separating means (15) comprising a separating plate (16) which is arranged in the pressure vessel (2) facing the inflow port (5) and spreads out substantially perpendicular to a flow line at the inflow port (5), wherein the gas-liquid separating means (15) has a peak shaped protrusion (18) which has a single crest (18*a*) projecting out in the direction of the inflow port (5) and a slanted surface (18*b*) on the separating plate (16) at a region facing the inflow port (5).

Accordingly, due to the effect of the peak shaped protrusion (18), the inflow of the refrigerant from the inflow port (5) can be smoothly converted to the substantially vertical direction and the separating plate (16) can be arranged in relative proximity to the inflow port (5) and the change of the flow cross-sectional area becomes smaller, so that the pressure loss of the refrigerant which occurs inside of the accumulator (1) can be kept small.

In the present invention, the gas-liquid separating means (15) has a circumferential wall part (17) which runs around the separating plate (16) so as to define a space (S1) which opens at the opposite side to the inflow port (5) and wherein an inlet (11) of the conduit (8) is arranged preferably in the space (S1) defined by the gas-liquid separating means (15). By virtue of this arrangement, the liquid refrigerant is prevented from entering inside the conduit (8) from the inlet (11) of the conduit (8).

In the present invention, the peak shaped protrusion (18) may have the shape of a cone.

In the present invention, a slanted surface (18*b*) of the peak shaped protrusion (18) is preferably curved in a recessed shape.

In the present invention, the crest (18*a*) of the peak shaped protrusion (18) may be positioned on the center axis (5*x*) of the inflow port (5).

In the present invention, the outflow port (6) may be arranged substantially parallel to the inflow port (5) and the crest (18*a*) of the peak shaped protrusion (18) may be offset from the center axis (5*x*) of the inflow port (5) in a direction away from the outflow port (6). By virtue of this arrangement, the conduit (8) which is connected to the inside of the outflow port (6) or the ring-shaped protrusion which is formed in the pressure vessel (2) for connecting the conduit (8) eases the extent of obstruction to the fluid which enters from the inflow port (5) and flows along the separating plate (16).

In the present invention, an inside surface of the pressure vessel (2) which faces the separating plate (16) may extend in parallel to the separating plate (16) and the gap (g)

between the separating plate (16) and the inside surface of the pressure vessel (2) may be ¼ times or more of the inside diameter (D) of the inflow port (5).

In the present invention, the crest (18*a*) of the peak shaped protrusion (18) may be of a height not more than the boundary surface of the inside space (S) of the pressure vessel (2) and the inflow port (5).

In the present invention, the conduit (8) is preferably configured as a double wall tube which is comprised of an inside tube (9) and an outside tube (10) which surrounds the inside tube (9), where one end of the inside tube (9) is connected to the outflow port (6) and the other end is opened at the inside of the outside tube (10), and the end of the outside tube (10) which has an inlet (11) for introducing a gaseous refrigerant flares out in a trumpet shape. By virtue of this arrangement, it is possible to suppress pressure loss of the gaseous refrigerant at the inlet (11) of the conduit (8).

DESCRIPTION OF EMBODIMENTS

An accumulator 1 according to an embodiment of the present invention will be explained while referring to the longitudinal cross-sectional view of FIG. 1 and FIG. 2, which is an enlarged view of principal parts of FIG. 1.

Figure 1:
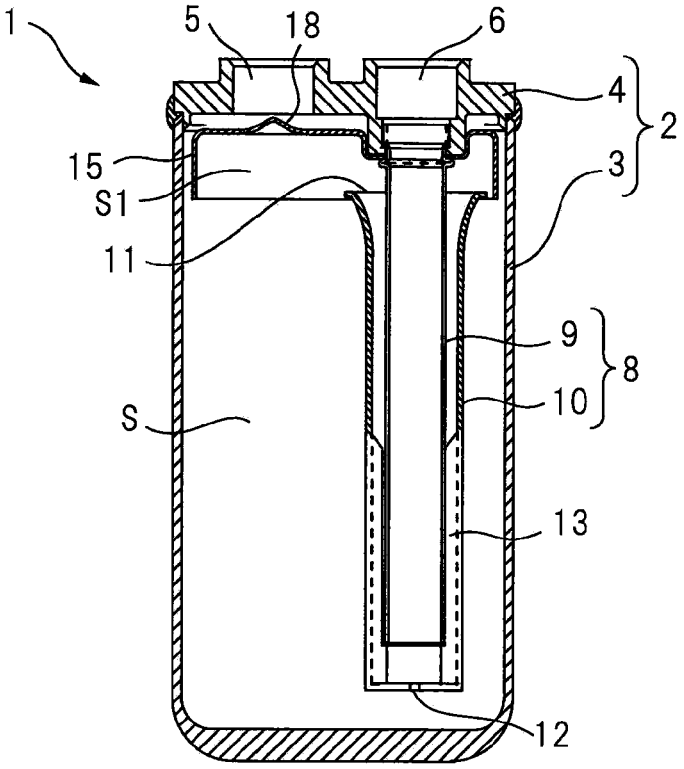
FIG. 1 is a longitudinal cross-sectional view of an accumulator according to an embodiment of the present invention.

The accumulator 1 which is shown in FIG. 1 is arranged at the suction side of a not shown compressor of an automobile-use refrigeration cycle system. The accumulator 1 comprises a cylindrically shaped pressure vessel 2 which forms an inside space S. The pressure vessel 2 has a deep, closed bottom tube-shaped vessel body 3 with an open top part and an overall substantially disk shaped lid member 4 which closes the open top part of the vessel body 3. The lid member 4 is joined with the vessel body 3 by welding, whereby the pressure vessel 2 is formed. The lid member 4 is provided with an inflow port 5 and outflow port 6 of a fluid which flows in the up-down direction of FIG. 1. At the outside of the inflow port 5, a feed pipe (not shown) which guides refrigerant from an evaporator is connected. At the outside of the outflow port 6, a discharge pipe (not shown) which discharges refrigerant to the compressor is connected. The lid member 4 has a ring-shaped projecting part 7 around the outflow port 6 at the inner side. The projecting part 7 is connected to an inside tube 9 of a conduit 8, which is explained later.

The accumulator 1 of FIG. 1 further comprises inside it the conduit 8 which guides refrigerant inside the pressure vessel 2 to the outflow port 6 and a gas-liquid separating means 15 which is provided facing the inflow port 5. The conduit 8 of the present embodiment is formed as a double wall tube 8 which is comprised of an inside tube 9 and an outside tube 10 which surrounds it. The double wall tube 8 extends vertically downward right under the outflow port 6. The top end of the inside tube 9 is joined to the outflow port 6 of the lid member 4 of the pressure vessel 2, while the bottom end opens inside of the outside tube 10. The outside tube 10 has an inlet 11 at the top end part which flares out in a trumpet shape. The inlet 11 is positioned at a height whereby it is included in the space S1 which the gas-liquid separating means 15 defines. The bottom end part of the outside tube extends up to close to the bottom of the pressure vessel 2. The bottom end part of the outside tube 10 is provided with a small oil return hole 12, but is closed, except for the hole 12. Furthermore, four fins 13 (in FIG. 1, only two shown) are provided extending from the inner circumferential surface of the substantially bottom half of the outside tube 10 toward the center until contiguous with the outer circumferential surface of the inside tube 9. Through these fins 13, the outside tube 10 is joined with the inside tube 9.

The top end of the inside tube 9 is connected to the outflow port 6 by inserting the top end of the inside tube 9 into the ring-shaped projecting part 7 of the lid member 4, then enlarging it in diameter. At this time, a recessed part 16*a* which is formed at a later explained separating plate 16 of the gas-liquid separating means 15 is fastened by sandwiching it between the end face of the ring-shaped projecting part 7 of the lid member 4 and the inside tube 9, so a ring-shaped bead 14 is formed at the inside tube 9 by, for example, beading.

The gas-liquid separating means 15 of the present embodiment has a separating plate 16 which spreads out substantially horizontally, as shown in FIG. 1, in other words, substantially perpendicular to the direction of the flow lines at the inflow port 5, and a circumferential wall part 17 which extends downward from the outer circumferential part of the separating plate 16. The gas-liquid separating means 15 is formed with a space S1 which opens at the opposite side to the inflow port 5 by the separating plate 16 and the circumferential wall part 17. Inside of this space S1, as explained above, an inlet 11 of an outside tube 10 of the conduit 8 is opened. The gas-liquid separating means 15 has an integrally formed peak shaped protrusion 18 which has one crest 18*a* which protrudes the direction of the inflow port 5 and slanted surfaces 18*b* at the region of the separating plate 16 which faces the inflow port 5. The peak shaped protrusion 18, as shown by the further partial enlarged view of FIG. 2 constituted by FIG. 3, is shaped similar to a cone which has a round bottom surface in the present embodiment, but the slanted surface 18*b* is curved in a recessed shape and therefore the shape is different from a conical shape. The crest 18*a* of the protrusion 18 is arranged on the center axis 5*x* of the inflow port 5 in the present embodiment. The tip of the crest reaches exactly the inside open surface of the inflow port 5, i.e. the boundary surface between the inside space S of the pressure vessel 2, and more particularly, the later explained upper separating plate space S2, and the inflow port 5.

The inside surface of the lid member 4 of the pressure vessel 2 extends flat and horizontally, except at the ring-shaped projecting part 7 at the inside of the outflow port 6. As a result, with the separating plate 16 of the gas-liquid separating means 15, a space S2 which has a substantially uniform height "g", except at the region of the peak shaped protrusion 18 is formed. It should be noted that the space S2 will hereinafter be referred to as an "upper separating plate space S2". In the accumulator shown in FIGS. 1 to 3, the gas-liquid separating means 15 is arranged so that the height "g" of the upper separating plate space S2 becomes ¼ of the inside diameter D of the inflow port 5. In the structure of this embodiment of the present invention, the height "g" of the upper separating plate space S2, i.e. the gap "g" between the separating plate 16 and the inside surface of the lid member 4, differs in optimal value, depending on the conditions of the flow rate of the inflowing refrigerant and the size of a gap S3 between the circumferential wall part 17 of the gas-liquid separating means 15 and the inner circumferential surface of the pressure vessel (referred to below as a "circumferential wall gap S3") etc., but in general ¼ to 1 time the inside diameter D of the inflow port 5 is preferable.

The "inside diameter D of the inflow port" in the terms in this Description means the inside diameter D of the flow channel at the inflow side contiguous with the inside space S of the pressure vessel 2. As a result, in the case of the embodiment which is shown in FIGS. 1 to 3, "the inside diameter D of the inflow port" matches the inside diameter D of the inside open surface of the inflow port 5 which is formed in the lid member 4. However, in another not shown embodiment, when the tip of the feed pipe from the evaporator is inserted up to the inside end face of the lid member 4, the inside diameter of the tip part of the feed pipe becomes the "inside diameter of the inflow port".

Next, how an accumulator 1 of the embodiment of FIG. 1 operates will be explained.

Figure 2:
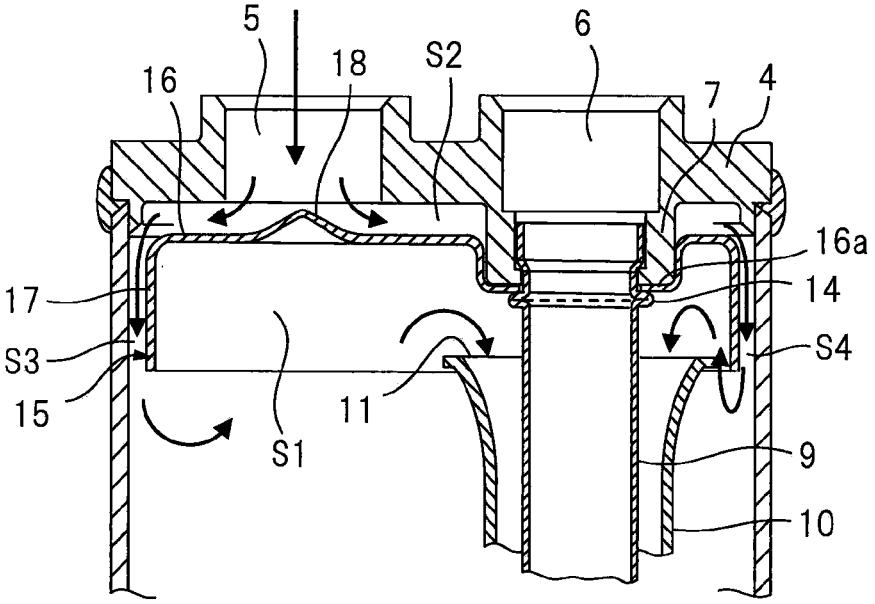
FIG. 2 is a partial enlarged longitudinal cross-sectional view of a top part of an accumulator of FIG. 1.
Figure 3:
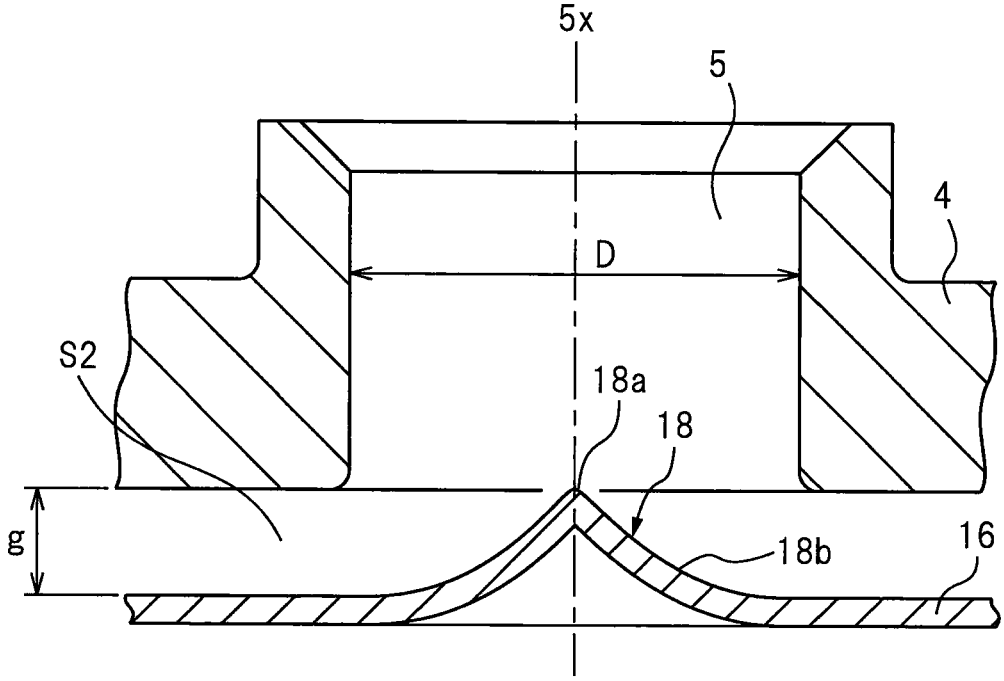
FIG. 3 is a further partial enlarged longitudinal cross-sectional view of principal parts of FIG. 2.
Figure 4:
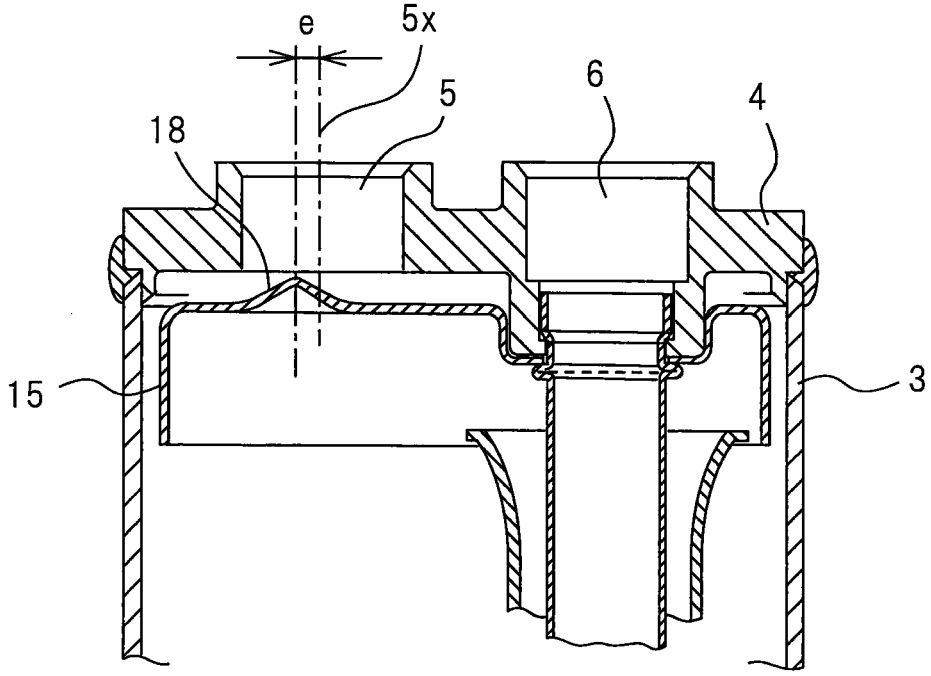
FIG. 4 is a partial enlarged longitudinal cross-sectional view of a top part of a modification of an accumulator according to an embodiment of the present invention.

The gas/liquid dual phase refrigerant which is discharged from the evaporator (not shown) is introduced from the inflow port 5 of the accumulator 1 substantially vertically downward such as shown by the arrow in FIG. 2, and strikes the separating plate 16 of the substantially horizontally arranged gas-liquid separating means 15. As a result, the large mass liquid phase refrigerant and the oil which is contained in the refrigerant deposit on the front surface of the gas-liquid separating means 15 and the inside surface of the pressure vessel 2, drip downward from there, and are stored in the vessel 2. On the other hand, the gaseous refrigerant passes through the circumferential wall part gap S3, flows from the inlet 11 at the top end part of the outside tube 10 to the inside of the double wall tube 8, rises from the opening at the bottom end of the inside tube 9 through the inside of the inside tube 9 to reach the outflow port 6, and is discharged to the compressor (not shown).

In the accumulator 1 of the present embodiment, the liquid refrigerant which is stored close to the bottom part of the pressure vessel 2 and contains a large amount of oil is also sucked into the double wall tube 8 through the small oil return hole 12 which is provided at the bottom part of the outside tube 10 and returned to the compressor together with the gaseous refrigerant.

In the accumulator 1 of the present embodiment, the refrigerant which flows in from the inflow port 5 is smoothly converted in flow from a vertical to a horizontal direction by the action of the peak shaped protrusion 18 which is provided on that separating plate 16 facing the inflow port 5, so that pressure loss is reduced compared with when there is no peak shaped protrusion 18. Furthermore, since the height "g" of the upper separating plate space S2 is set to relatively less in the present embodiment, i.e. to ¼ of the inside diameter D of the inflow port 5, the change in cross-sectional area of the flow is smaller. More specifically, the rate of increase of the flow cross-sectional area of the upper separating plate space S2 to the flow cross-sectional area of the inflow port 5 and the rate of decrease of the flow cross-sectional area of the circumferential wall part gap S3 to the flow cross-sectional area of the upper separating plate space S2 is relatively smaller, and thus pressure loss of the refrigerant gas is kept small.

Further, the inlet 11 of the double wall tube 8 into which the separated gas refrigerant flows flares out in a trumpet shape, whereby pressure loss at this part is also kept small.

Other Embodiments

While the peak shaped protrusion 18 is shaped similar to a conical shape having a circular bottom in the above embodiment, and thus the slanted surface 18*b* is shaped curved in a recessed shape, an embodiment wherein the peak shaped protrusion 18 is a conical shape or a prismatic shape which has a straight slanted surface or surfaces 18*b* (not shown) is also possible.

In the peak shaped protrusion 18 of the above embodiment, the tip of the crest 18*a* reaches exactly the inside open surface of the inflow port 5. However, the optimal value of the height of the peak shaped protrusion 18 differs, for example, depending on the height "g" of the upper separating plate space S2 as well. Therefore, the pressure loss sometimes falls more in an embodiment wherein the height is lower than that of the embodiment of FIG. 3 and the tip does not reach the open surface (not shown).

Figure 5:
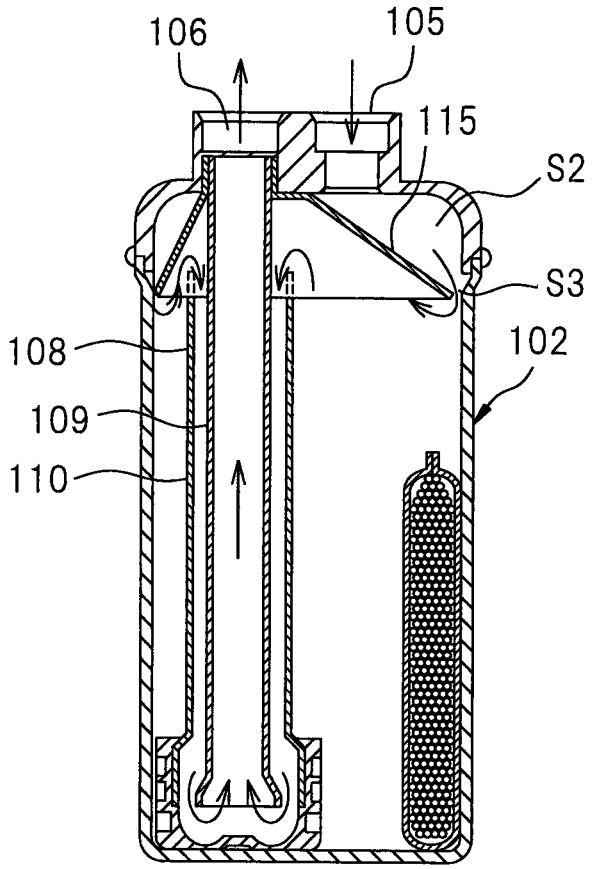
FIG. 5 is a longitudinal cross-sectional view according to the prior art.

Since the outflow port 6 must be joined with the inside tube 9, the ring-shaped projecting part 7 is formed at the inside of the lid member 4. However, the ring-shaped projecting part 7 becomes an obstruction to the fluid which flows in from the inflow port 5 and flows toward the circumferential wall part 17. For this reason, to ease the effects of this obstacle and therefore the pressure loss, an embodiment is also possible wherein the horizontal direction position of the crest 18*a* of the peak shaped protrusion 18, as shown in FIG. 5, is offset by a distance "e" from the center axis 5*x* of the inflow port 5 in a direction away from the outflow port 6. It should be noted that while not shown, a structure wherein the inside tube 9 is joined with the outflow port 6 without forming the ring-shaped projecting part 7 at the inside of the lid member 4 is also easily possible, although in such a case, the inside tube 9 itself becomes an obstruction to the flow of the gaseous refrigerant.

In the embodiment of FIGS. 1 to 3, the peak shaped protrusion 18 is formed integrally with the separating plate 16. However, an embodiment wherein the peak shaped protrusion is a member separate from the separating plate and is comprised of a member which is attached to the separating plate by, for example, screws or other fastening means (not shown) is also possible.

The gas-liquid separating means 15 of the above embodiment has a circumferential wall part 17. However, an embodiment wherein the gas-liquid separating means 15 does not have a circumferential wall part 17 (not shown) is also possible.

The conduit 8 in the above embodiment is comprised of a double wall tube. However, an embodiment wherein the conduit 8 is a tubular structure other than a double wall tube, for example, wherein it is comprised of a single U-shaped tube which is bent in a U-shape, has one end connected to the outflow port 6, and has the other end opened inside of the inside space S of the pressure vessel 2 (not shown) is also possible.

While the present invention is explained in detail based on specific embodiments, it should be apparent that a person skilled in the art could make various changes, corrections, etc. without departing from the scope of the claims and overall concept of the present invention.

REFERENCE SIGNS LIST

1 accumulator
2 pressure vessel

3 vessel body
4 lid member
5 inflow port
6 outflow port
8 conduit
9 inside tube
10 outside tube
11 inlet
15 gas-liquid separating means
16 separating plate
17 circumferential wall part
18 peak shaped protrusion

The invention claimed is:

1. An accumulator adapted to be arranged at a suction side of a compressor in a refrigerant circuit, separates a refrigerant into a gas and liquid, and stores the liquid refrigerant, the accumulator comprising:

a pressure vessel which forms an inside space;

an inflow port of the refrigerant and an outflow port of the refrigerant which are provided at the pressure vessel;

a conduit which guides the refrigerant in the pressure vessel to the outflow port, and a gas-liquid separating means comprising a separating plate which is arranged in the pressure vessel facing the inflow port and spreads out substantially perpendicular to a flow line at the inflow port;

wherein the gas-liquid separating means has a peak shaped protrusion which is comprised of a single crest projecting out in the direction of the inflow port and a single continuous slanted surface on the separating plate at a region facing the inflow port, wherein an inside surface of the pressure vessel which faces the separating plate extends in parallel to the separating plate, and a gap between the separating plate and the inside surface of the pressure vessel is ¼ to 1 times the inside diameter of the inflow port, wherein the gas-liquid separating means has a circumferential wall part running around the separating plate so as to define a space which opens at the opposite side to the inflow port and the circumferential wall part extending downward from an outer circumferential part of the separating plate, and wherein an inlet of the conduit is arranged in the space defined by the gas-liquid separating means, and wherein a gaseous refrigerant passes through a gap defined between the circumferential wall part of the gas-liquid separating means and an inner circumferential surface of the pressure vessel.

2. The accumulator according to claim 1, wherein the peak shaped protrusion has the shape of a cone.

3. The accumulator according to claim 1, wherein the slanted surface of the peak shaped protrusion is curved in a recessed shape.

4. The accumulator according to claim 1, wherein the crest of the peak shaped protrusion is positioned on a center axis of the inflow port.

5. The accumulator according to claim 1, wherein the outflow port is arranged substantially in parallel to the inflow port, and the crest of the peak shaped protrusion is offset from the center axis of the inflow port in a direction away from the outflow port.

6. The accumulator according to claim 1, wherein the crest of the peak shaped protrusion is of a height not more than a boundary surface between the inside space of the pressure vessel and the inflow port.

7. The accumulator according to claim 1, wherein the conduit is configured as a double wall tube which is comprised of an inside tube and an outside tube which surrounds the inside tube, one end of the inside tube is connected to the outflow port and the other end is opened at the inside of the outside tube, and the end of the outside tube which has an inlet for introducing of a gaseous refrigerant flares out in a trumpet shape.

* * * * *